United States Patent [19]

Stanek et al.

[11] Patent Number: 4,461,605

[45] Date of Patent: Jul. 24, 1984

[54] PROCESS FOR MANUFACTURING LIDS WITH A CLOSURE STRIP COVERING AT LEAST ONE POURING HOLE, IN PARTICULAR SUCH LIDS FOR BEVERAGE CANS

[75] Inventors: Oldrich Stanek; Siegfried Bloeck, both of Kreuzlingen, Switzerland

[73] Assignee: Swiss Aluminium Ltd., Chippis, Switzerland

[21] Appl. No.: 373,399

[22] Filed: Apr. 30, 1982

[30] Foreign Application Priority Data

May 7, 1981 [CH] Switzerland ..... 2962/81

[51] Int. Cl.[3] ..... B21B 51/00

[52] U.S. Cl. ..... 413/8; 413/19; 220/260; 220/270

[58] Field of Search ..... 220/260, 359, 270, 271; 413/18–20, 58–60, 12

[56] References Cited

U.S. PATENT DOCUMENTS

| | | | |
|---|---|---|---|
| 4,215,791 | 8/1980 | Brochmann | 220/271 |
| 4,311,741 | 1/1982 | Wong | 220/260 |
| 4,378,074 | 3/1983 | Brochmann | 220/260 |
| 4,397,401 | 8/1983 | Ueno | 220/260 |

*Primary Examiner*—Leon Gilden

*Attorney, Agent, or Firm*—Bachman and La Pointe

[57] ABSTRACT

Lids made of aluminum alloys or ferrous material such as tin plate or tin free steel having at least one stamped out pouring hole and, if desired, at least one hole for air have hot sealed pull-off strips covering the said holes. On the inner side of the lids the region around the holes is pre-treated with an adhesive primer and then coated with a plastisol layer thus providing the cut edges at the holes with protection against attack by the contents of the can.

12 Claims, 4 Drawing Figures

Fig. 1
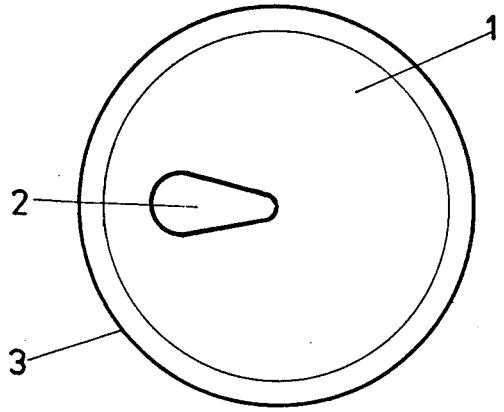
Fig. 2
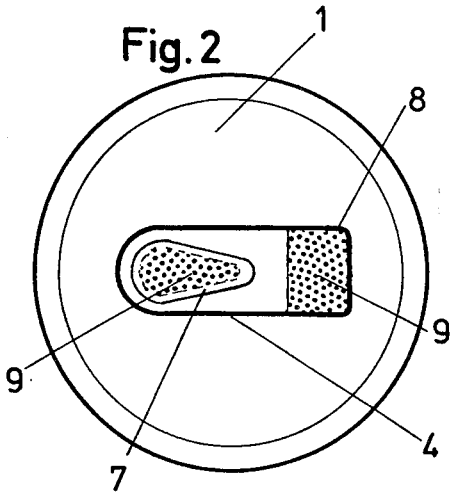
Fig.3
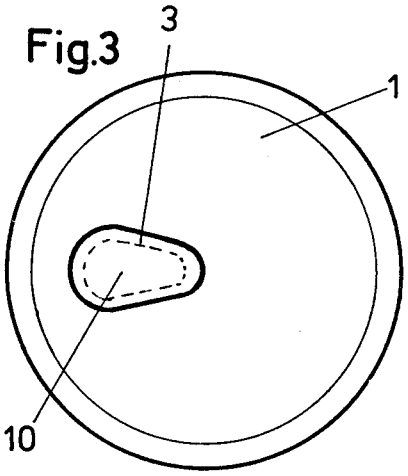
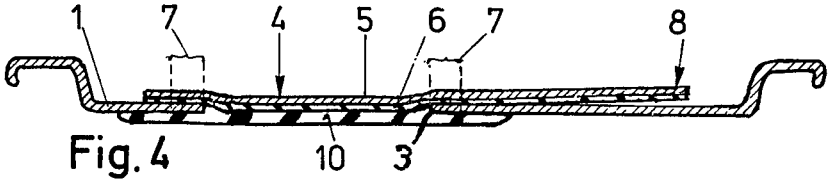
Fig. 4

PROCESS FOR MANUFACTURING LIDS WITH A CLOSURE STRIP COVERING AT LEAST ONE POURING HOLE, IN PARTICULAR SUCH LIDS FOR BEVERAGE CANS

BACKGROUND OF THE INVENTION

The present invention relates to a process for manufacturing lids, in particular lids for beverage cans. Such lids are most often made of aluminum (pure aluminium or an aluminium alloy), tin plate or tin free steel (TFS) and are usually coated, at least on the inside face, with a protective layer of lacquer e.g. a phenolic epoxy based lacquer.

It is known to provide such lids with a pouring hole or group of holes and, if desired, at least one air inlet hole.

These holes are then covered over with a sealed on, pull-off closure strip. Such strips are, advantageously, made of an approximately 0.9–0.14 mm thick aluminium foil which is coated on the side to be sealed to the lid with a coating of thermoplastic plastic e.g. about 0.015–0.03 mm thick, usually about 0.02 mm thick. Before applying that plastic layer, however, the aluminium is usually coated first with a thinner layer of phenolic epoxy lacquer. The outside of the strip is usually covered with a decorative lacquer coating. Strips of aluminum-polyamide laminate, in particular with a polyamide-12 coating, have proved to be very suitable for this purpose.

For production reasons the lid material is lacquered in strip or sheet form and the lids prepared from that with the pouring and, if desired, airing holes being punched out of the material in the process. The result is, however, that the cut edges around the holes are then left unprotected. These unprotected edges are undesireable as they are exposed to corrosive attack by the contents, in particular by such ones containing $CO_2$; the corrosion products could lead to spoiling of the contents. Such a phenomenon is already found to occur to a moderate degree with aluminium lids; it is however more pronounced in the case of lids made of ferrous material (tin plate or TFS). For example at a concentration of only 1 mg Fe-ions per liter beer becomes cloudy, also some cola drinks at a concentration of 1.5 mg Fe per liter.

SUMMARY OF THE INVENTION

The object of the present invention is, therefore to eliminate these problems encountered with lids which have stamped out holes covered over with sealed-on closure strips and to develop such a lid where the cut edges of the holes are not attacked by the contents.

This object is achieved by way of the process according to the invention in that after sealing on the closure strip, the free surface of the strip in the hole and the area of lid material surrounding the hole are treated with an adhesive primer from the inner side of the lid, this primer dried and on top of that primer coating a plastisol layer deposited and then allowed to gel by means of heat treatment.

BRIEF DESCRIPTION OF THE DRAWINGS

An exemplified embodiment of the invention is shown in the accompanying drawings viz., FIG. 1, a lid with punched out hole in it.

FIG. 2, a lid with closure strip sealed onto it.

FIG. 3, a lid according to FIG. 2 with plastisol coating, viewed from the side which faces into the can.

FIG. 4, the lid viewed in cross section.

DETAILED DESCRIPTION

The heat treatment can be carried out at 130° to 170° C. for 5 seconds to 15 minutes, e.g., in an air-circulating oven, by infrared heating or some similar means. The thickness of the plastisol layer is preferably 0.1–0.25 mm.

Epoxidize polymethyl methacrylate has been found to be particularly suitable as an adhesive primer here. Also applicable for this purpose, however, are other polyacrylic esters, in particular poly-methylacrylic esters especially in their epoxidized form.

Such adhesive primers are preferably deposited in the form of a 0.05–0.5% solution in suitable solvents, if desired also as a dispersion, e.g., by spraying, and this in such an amount that the primer layer deposited is 0.05–15 $g/m^2$, preferably 0.1–2 $g/m^2$. The epoxidized polyacrylic ester can be dissolved, e.g., in methyl-ethyl-ketone.

The adhesive primer solution dries relatively quickly on the inner face of the lid. If necessary the drying can be speeded up e.g. by a stream of hot air.

The above pretreatment of the area in question on the inner face of the can lid also results in the plastisol coating adhering satisfactorily not only to the lacquered surface of the lid material, but also to the freely exposed plastic coating, in particular polyamide-coating, of the closure strip.

The result is that all danger of the contents penetrating between the plastisol layer and the closure strip to come into contact with the cut edge is eliminated. Likewise it ensures that when the closure strip is pulled off, the area of strip to which the plastisol layer is adhering is pulled off with the strip right up to the edge of the hole.

It was found in preliminary trials that, without this pretreatment with an adhesive primer, the plastisol layer adhered poorly in particular on the exposed surface of an aluminum-polyamide laminate closure strip; the result was that on pulling off the strip, it separated from the plastisol film which continued to bridge the hole (windowing) or remnants of the plastisol film remained at the edge of the hole (feathering), which spoils appearances.

Further, the area on the closure strip coinciding with the pouring hole is often embossed, e.g., in the form of a uniform pattern of projections and depressions.

If the plastic or in particular the polyamide coating is damaged or weakened during the embossing stage, then such places are covered over by the plastisol layer. This is especially important if such strips are employed on tin plate or tin free steel lids as, unlike the case with aluminium lids, there is then a danger of corrosion due to the presence of galvanic pairs.

A good basis for achieving complete edge protection with plastisol is attained if the plastisol reaches right up to the line of sealing between the strip and the lid. For this reason the seal is usefully arranged such that it extends right up to the edge of the hole. This ensures that no air pockets are formed between the plastisol layer and the seal.

According to a further development of the invention it has been found advantageous, before applying the plastisol, preferably even before applying the primer, to press the part of the closure strip lying over the hole into the hole, and in such a manner that the inner face of the strip lies approximately in the same plane as the inner face of the can lid; as a result there is a slight depression in the strip corresponding in depth to the thickness of the lid. The advantage of this is that the plastisol in particular can be applied with a stamping type of tool which has a working face in one plane, ensuring that this film is actually deposited uniformly over the whole of the area in question. When hot sealing on the closure strip, it often happens that as a result of temperature gradient the region spanning the hole in the lid does not remain flat, but bulges to a greater or lesser degree outwards or inwards. Such irregularities are unfavorable for the application of the plastisol, especially if a trough-shaped depression forms on the inner side where the plastisol can run in and no longer provide with certainty the desired protection of the cut edge. Such undesired deformation is avoided by the described pressing of the strip into the hole.

The previously mentioned tool can, for example, be in the form of a brush with a number of steel pins which are mounted on the end of a support plate, with the shaft penetrating a perforated base of a chamber for the plastisol and the flattened ends in the one and the same plane forming the working surface. The shafts of the pins in the region of the perforated base are conical in shape, and in such a way that when the tool is in the non-operative position, they close off the holes in the base. In the coating operation the pins are pushed back through the support plate, whereby the holes are opened and the plastisol, which is under pressure in the tool container, is allowed to flow along the pins onto the surface to be coated.

The lid 1 shown (e.g. for beverage cans, especially beer cans) is made for example of tin free steel and features a droplet shaped pouring or drinking outlet 2 the longitudinal axis of which with respect to the lid lies in a radial direction.

This outlet hole 2 with cut edge 3 is closed off by a sealed on closure strip 4 made of an aluminum strip 5 coated with a polyamide-12-coating 6. The seal 7 around the hole is about 1–2 mm wide. The strip also features a free standing flap 8 which can be gripped to pull the strip away from the lid. This flap and the area of the strip over the hole feature an embossed pattern 9.

In the region of the hole the strip material has been pressed into the hole in such a way that the inner face of the strip lies approximately in the same plane as the inner face of the lid. This region and the surrounding part of the lid material have been pretreated with adhesive primer and completely covered with a PVC-plastisol layer 10, including cut edge 3 as clearly shown in FIG. 4.

In another version of the above, and in particular with larger outlet holes, it is also possible to cover only the cut edge 3 and its surrounds with the plastisol and to leave free of plastisol the central part of the strip which spans the hole.

What is claimed is:

1. Process for manufacturing a can lid with sealed on closure strip covering at least one pouring hole having cut edges therein which comprises providing said closure strip with polyamide heat sealable surface sealed thereon, sealing said closure strip to the can lid, treating the inner face of the strip and the surrounding region on the inner face of the lid material with an adhesive primer consisting of a solution of a polyacrylic ester, drying said primer, coating the treated region on the inner face of the lid including said cut edges with a plastisol layer , and allowing said plastisol layer to gel with the aid of a heat treatment, whereby said cut edges are not attacked by the can contents.

2. Process according to claim 1 wherein the adhesive primer is a solution of a polymethacrylate ester.

3. Process according to claim 2 wherein said adhesive primer is a solution of a polymethylmethacrylate.

4. Process according to claim 1 wherein the polyacrylic ester is in the epoxidized form.

5. Process according to claim 1 wherein the heat treatment of the deposited plastisol layer is carried out at 130° to 175° C. for 5 seconds to 15 minutes.

6. Process according to claim 1 wherein the adhesive primer solution is applied in such a quantity that the thickness of the remaining primer layer is 0.05–15 $g/m^2$.

7. Process according to claim 6 wherein the adhesive primer solution is applied in such a quantity that the thickness of the remaining primer layer is 0.1–2 $g/m^2$.

8. Process according to claim 1 wherein, before depositing the plastisol layer, preferably even before the pretreatment with adhesive primer, the part of the closure strip overbridging said hole is pressed into the hole, and in such a way that the inner face of the strip comes to lie approximately in the plane of the inner face of the can lid.

9. Process according to claim 8 wherein said part of the closure strip is pressed into the hole before pretreatment with adhesive primer.

10. Process according to claim 1 wherein on sealing on the closure strip, the seal is arranged such that it extends right up to the edge of the hole.

11. Process according to claim 1 wherein the closure strip is made of a thin aluminum strip coated with heat sealable polyamide.

12. Process according to claim 1 wherein the thickness of the plastisol layer is from 0.1 to 0.25 mm.

* * * * *